United States Patent [19]

Madill

[11] 4,130,924

[45] Dec. 26, 1978

[54] REMOVAL AND/OR INSTALLATION OF TOP SECTION OF STEELMAKING VESSEL

[75] Inventor: Kenneth D. Madill, Sault Ste. Marie, Canada

[73] Assignee: The Algoma Steel Corporation, Limited, Ontario, Canada

[21] Appl. No.: 838,222

[22] Filed: Sep. 30, 1977

[30] Foreign Application Priority Data

Jun. 27, 1977 [CA] Canada ..... 281398

[51] Int. Cl.[2] ..... B23P 7/00

[52] U.S. Cl. ..... 29/401 F; 266/281; 266/286; 266/246

[58] Field of Search ..... 29/401 F, 401 R; 266/246, 286, 281

[56] References Cited

U.S. PATENT DOCUMENTS

| | | | |
|---|---|---|---|
| 204,309 | 5/1878 | Fletcher | 266/286 |
| 909,801 | 1/1909 | Jackson et al. | 266/286 |
| 2,079,765 | 5/1937 | Goldberg | 266/286 |
| 3,146,983 | 9/1964 | Johnson | 266/246 |

FOREIGN PATENT DOCUMENTS

| | | | |
|---|---|---|---|
| 954148 | 4/1964 | United Kingdom | 266/246 |

*Primary Examiner*—C.W. Lanham
*Assistant Examiner*—V. K. Rising
*Attorney, Agent, or Firm*—Cushman, Darby & Cushman

[57] ABSTRACT

This relates to a method for facilitating the rapid and convenient installation and removal of the top section of a steelmaking vessel of a type that is rotatably mounted i.e. provided with trunnions. The method involves providing the top section with lifting brackets and also providing a hinge connection between the top section and the vessel body. During removal, the vessel body is rotated while lifting forces are applied to the brackets thereby causing the top section to be pivoted relative to the vessel body about the hinge. This process is carried out in such a way as to cause the top section to be moved outwardly over the operating platform following which the top section is gently lowered onto such platform. Following this, the top section is disconnected from the vessel body at the hinge and the necessary repairs to the top section are effected. Following repair, essentially the reverse of the above described procedure is carried out thereby to position the top section accurately on the body of the vessel.

3 Claims, 4 Drawing Figures

REMOVAL AND/OR INSTALLATION OF TOP SECTION OF STEELMAKING VESSEL

This invention relates to a method for facilitating the rapid and convenient installation and removal of the top section of a steelmaking vessel of a type that is rotatably mounted i.e. provided with trunnions.

BACKGROUND OF THE INVENTION

Those skilled in the art know that oxygen converter vessels and the like are subjected to intense heat during the refining of metal, such as steel, and thus have to be periodically repaired and particularly to have their refractory linings replaced from time to time. The top section of an oxygen vessel is particularly subject to severe operating conditions and must be repaired or replaced more often than the body of the vessel itself. In the experience of the assignee of the present invention, oxygen vessel top sections have a service life of approximately four years and produce some 15,000 heats. Other steelmakers using similar vessels have longer or shorter intervals between repairs, depending on their operating conditions.

The methods commonly employed in the industry to change vessel tops are relatively complex, time-consuming and expensive.

One popular method is to invert the vessel and to lower the top section with jacks onto a transfer car mounted on the tracks used for the slag and steel cars and to then move it from under the vessel to an adjoining aisle for transfer with an overhead crane. On replacement, the operation is reversed. The replacement top is placed onto the transfer car in the inverted position, moved under the vessel and then slowly jacked up into position against the inverted lower portion of the vessel.

Another method involves using a very heavy porter-bar with appropriate counter balancing mounted from an overhead crane (such as the charging aisle crane) to reach in under the gas hood and to lift the top section out and back in. The porter-bar would have to be a very large and expensive device for the load to be lifted and, in addition, would require the availability of a very high capacity overhead crane to handle the heavy loads involved.

Another technique involves building a strong structural support on the operating platform to the approximate height of the vessel joint which also cantilevers over to the vessel top cone joint, and then moving the vessel top across the support frame on rollers for transfer out on removal or movement in on replacement.

If overhead building structural steel of sufficient strength is available, basic rigging techniques may be used in conjunction with the available overhead crane to lift and transfer the suspended top section away from or into position on the vessel lower section. The assignee of the present invention used this technique during erection and it took about 10 hours to only place a top section into position.

The above-noted prior art techniques are very time consuming and can take from 8 to 24 hours to complete. This represents a substantial expense in terms of manpower and equipment time and in terms of lost production.

SUMMARY OF THE INVENTION

It is a principal object of the invention to provide an improved technique which facilitates the rapid and convenient installation or removal of a vessel top section either during initial erection or in the course of subsequent rebuilding or repairing of a vessel.

Accordingly, the invention provides a method of removing and/or installing a top section of a steelmaking vessel, the vessel including a lower body section with said top section being detachably secured thereto, there being an operating platform including a vessel charging side alongside of said vessel, said vessel top section further being provided with lift bracket means on that side of the vessel nearest the charging side of the operating platform, and said body section being mounted for rotation about a horizontal axis. The method includes providing a hinge connection between the top section and the body section of the vessel such that the hinge axis is parallel to the rotation axis of the vessel, said hinge being located to that side of the vessel which is remote from the charging side of the operating platform. The vessel top section is removed, in accordance with one aspect of the invention, by rotating the body section about the rotation axis from an upright position toward the charging side of the operating platform while simultaneously applying lifting forces to said vessel top section via the lift bracket means to support the same whereby the top section pivots relative to said body section about the hinge axis. The rotation of the body section is continued while supporting the top section and controlling the orientation thereof so that the top section is carried out over the operating platform and progressively lowered onto same. The top section is then separated from the body section at the hinge connection and subsequently repaired or replaced. The method of installing a repaired or a replacement vessel top section includes locating the top section on the operating platform and connecting the top section to the inclined body section via the hinge connection. The body section is then rotated from the inclined position toward the upright position while simultaneously applying lifting forces to the top section via the bracket means to support the top section and to control the orientation thereof. By virtue of this action the top section is carried away from the operating platform and gradually is pivoted relative to the body section back into close juxtaposition therewith following which the body section and top section are secured together in any suitable fashion.

By using the above described method, it has been found that the time required to change the top section of an oxygen vessel can be reduced from 8 to 24 hours (depending on the prior art technique used) to something less than 3 and ½ hours (again depending somewhat on conditions). The savings in time and cost are substantial.

In the case of new vessels, the hinge and bracket arrangements may be included in the design at the time of fabrication. The hinge and bracket devices can also be economically and quickly added to and removed from existing vessels with a flanged (or even without a flange) top section to facilitate top section removal and replacement during a rebuild and need not be a permanent feature of the vessel.

The invention will now be described by way of example with reference being made to the drawings appended hereto.

DETAILED DESCRIPTION

Figure 1:
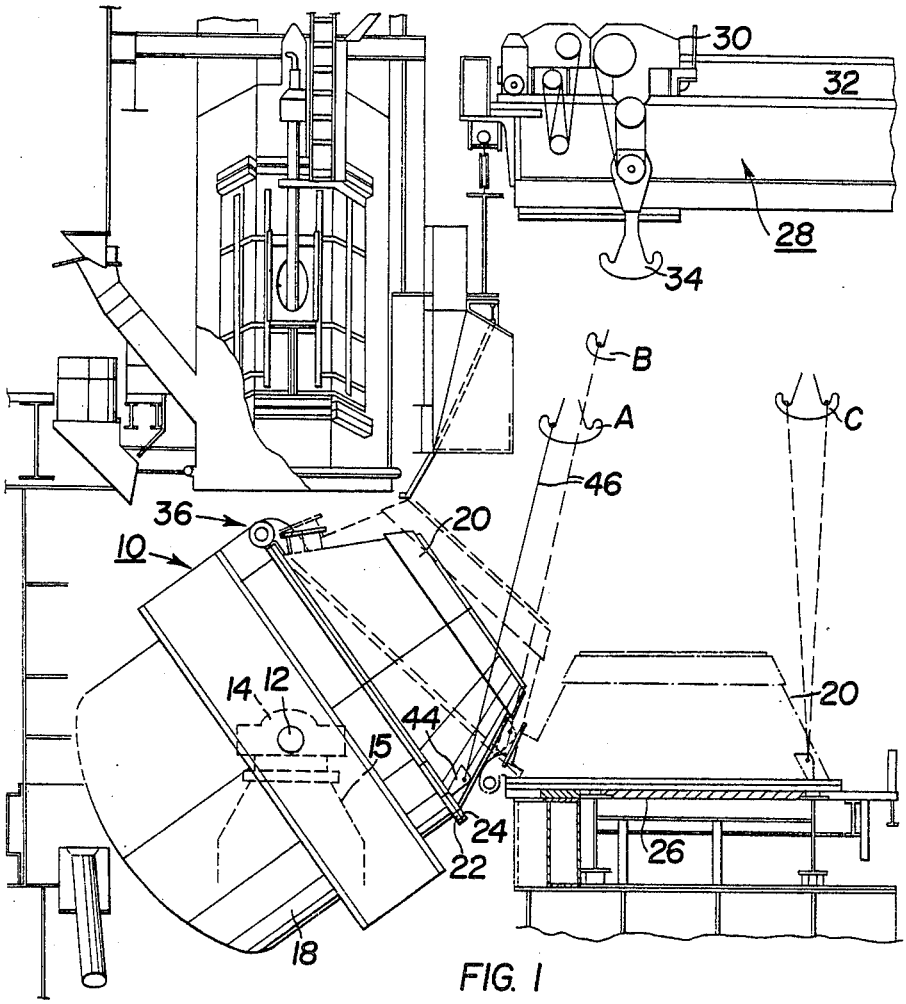
FIG. 1 is an elevation view of an oxygen converter vessel and certain of the structures normally associated therewith in a steelmaking plant and illustrates the new method.
Figure 2:
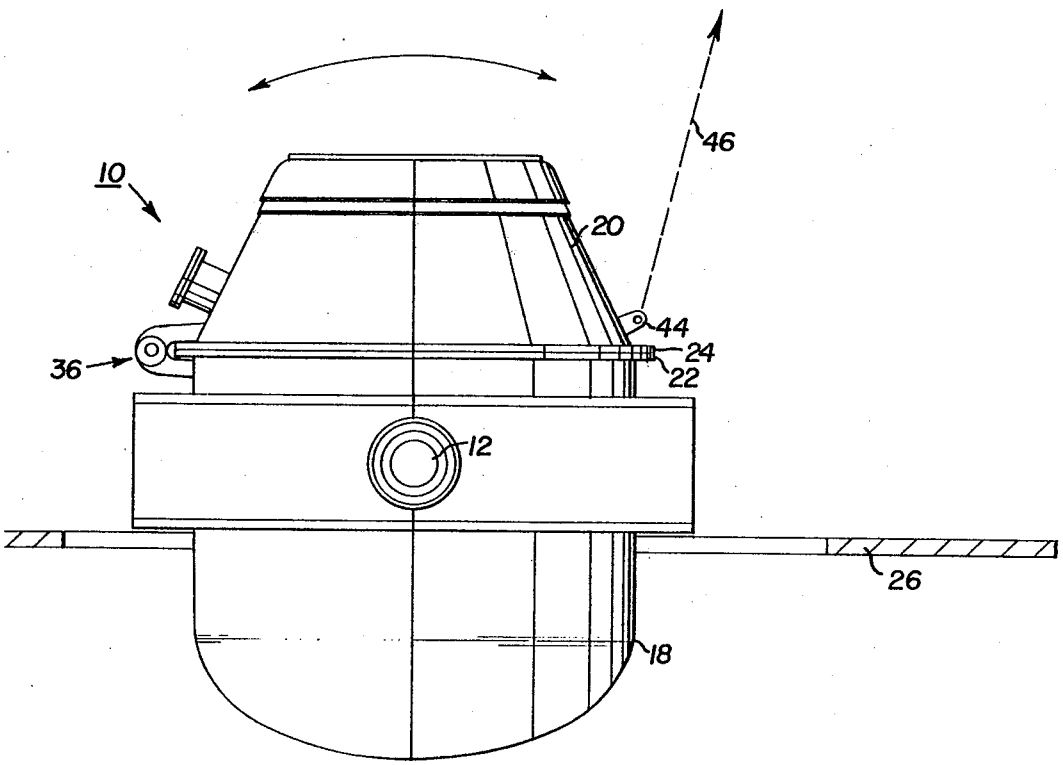
FIG. 2 is an elevation view of the converter vessel per se illustrating the hinge and lift bracket arrangement.
Figure 3:
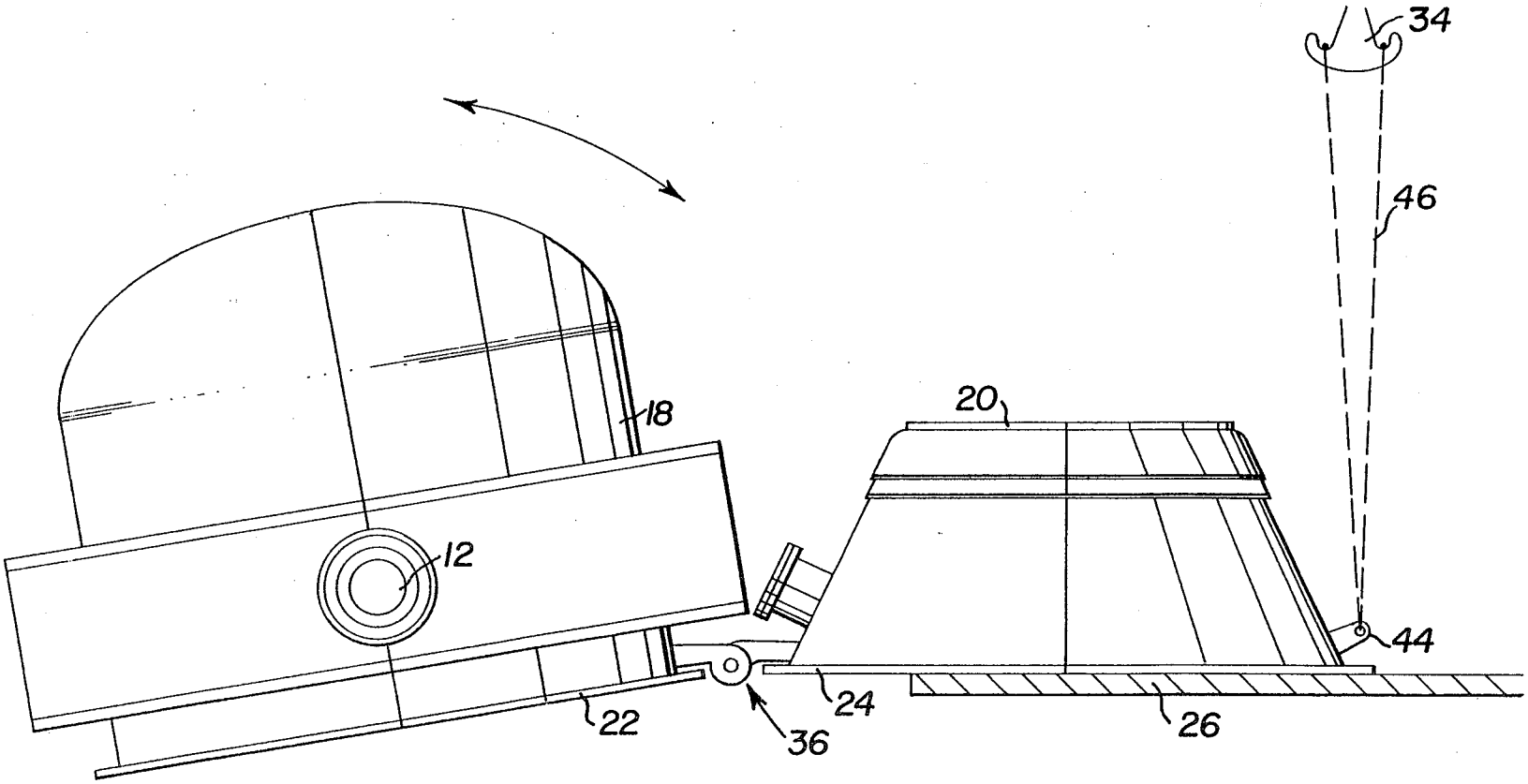
FIG. 3 is an elevation view of the converter vessel, with the top section thereof being supported on the operating platform in the final position assumed thereby on removal or the initial position for replacement of the top section.

With reference now to the drawings, FIG. 1 shows an oxygen process converter vessel 10 which is, per se, of conventional construction and is rotatably supported on oppositely directed trunnions 12, the latter being mounted in bearing blocks. 14 supported from suitable pedestal means 15. A suitable motor drive (not shown) is connected to one of the trunnions 12 thereby to effect rotation of the converter vessel 10 about the rotation axis defined by such trunnions.

The vessel 10 includes a lower body section 18 and a generally conically shaped top section 20, both the body section 18 and top section 20 having mating annular flange portions 22 and 24 respectively which are normally secured together by means of a plurality of circumferentially spaced apart bolts (not shown) extending through the juxtaposed flanges 22 and 24.

Both the top section 20 and body section 18 are lined with refractory brick in the usual manner. The refractory brick, as well as other portions of the vessel 10 gradually deteriorates as a result of the severe operating conditions encountered during normal usage, such deterioration being particularly severe in the case of the top section 20.

The other structures normally associated with an oxygen converter vessel of the type shown need not be described here since they are very well known to those skilled in the art. However, it is noted here that a horizontal operating platform is provided closely adjacent the converter vessel that portion of the operating platform which is located to the charging side of the converter vessel being designated by the reference numeral 26. In addition, as illustrated in FIG. 1, there is provided an overhead charging crane assembly for the converter, which assembly is designated by reference numeral 28. The charging crane includes a travelling powered winch assembly 30 which travels back and forth along track assembly 32. Suspended from the powered winch 30 is a lift hook assembly 34.

Figure 4:
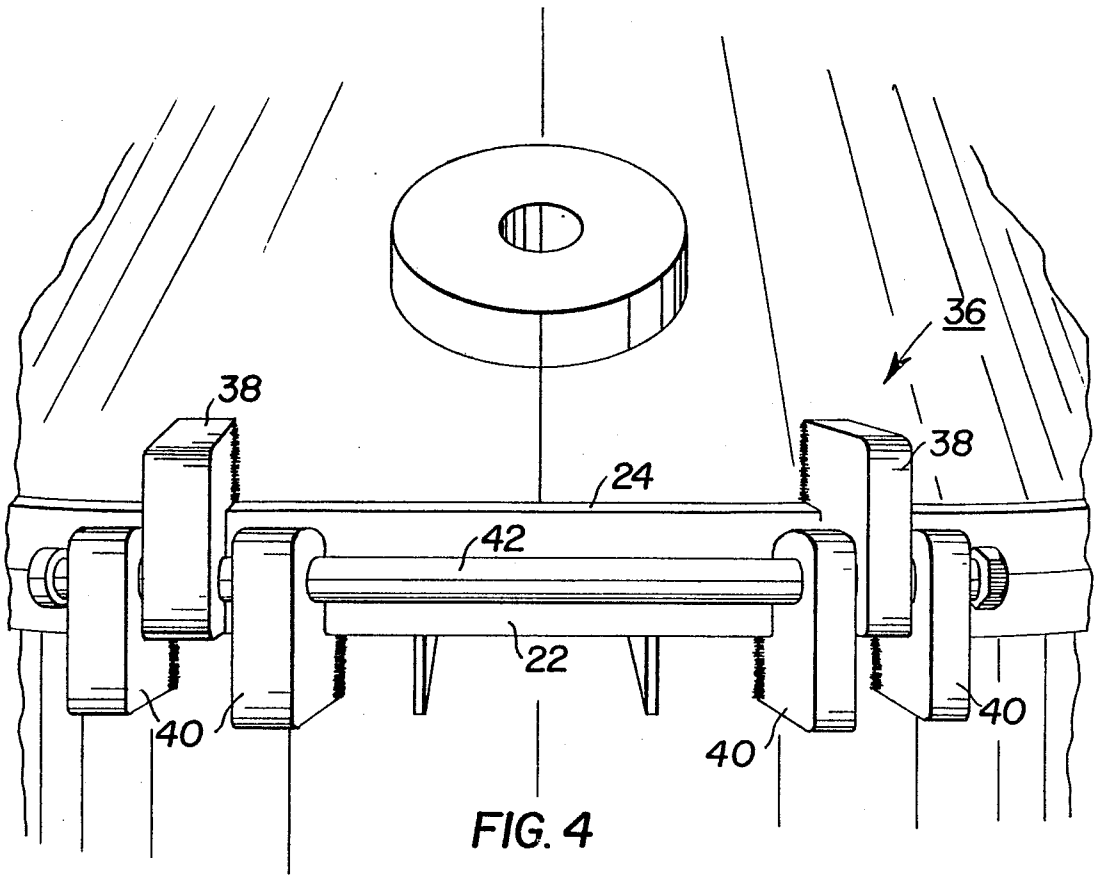
FIG. 4 is a perspective view of the hinge arrangement which serves to interconnect the top and bottom sections of the converter vessel during the course of removal or replacement of the vessel top section.

In accordance with the invention, a hinge connection 36 is provided between the top section 20 and the body section 18 of the vessel. The hinge 36 is located to that side of the vessel which is remote from the charging side 26 of the operating platform when the vessel is in the upright position. The hinge 36 is more clearly shown in FIG. 4 and it will be seen that it comprises sturdy hinge elements 38 and 40 securely welded to the flange members 24 and 22 respectively of the top and body sections of the vessel 10. A sturdy hinge pin 42 passes through the respective hinge elements 38 and 40 and defines a hinge axis which is parallel to the rotation axis of the vessel 10 as defined by the opposed trunnions 12. The hinge pin 42 includes a removable nut at one end thereof (or other suitable removable means) which can be removed, thus permitting the hinge pin 42 to be removed in the endwise direction to separate the hinge elements 38 and 40 from one another.

The top section 20 of the vessel is also provided with lifting brackets 44 provided on that side of the top section nearest the charging side 26 of the operating platform. The lifting brackets may be of a very simple construction and may be of any suitable design so long as cables may be attached thereto to permit lifting upwardly of the top section 20 during the vessel top removal or installation procedures which will now be described. It will be assumed that the hinge 36 has been previously installed and that the various bolts interconnecting the flanges 22 and 24 have previously been removed. Heavy cables 46 are connected to the lifting brackets 44 on the top section 20 with the upper ends of such cables being attached to the lift hook assembly 34 of the charging crane 28. The converter vessel 10 is then slowly tilted toward the charging side 26 of the operating platform. At the same time as the tilting action takes place, lifting forces are applied to the vessel top section 20 via hook assembly 34, cables 46 and lift brackets 44. By virtue of the combined tilting action of the vessel 10 and the lifting action, the top section 20 is caused to pivot relative to the body section 18 about the hinge axis defined by hinge 36. This action eventually causes the top section 20 to assume the intermediate position illustrated in phantom in FIG. 1. The lifting forces continue to be applied to lift brackets 44 as rotation of the vessel body 18 is continued. Both the rotation action and the lifting action are carefully coordinated thereby to maintain the top section 20 in suitable orientation during the procedure. The hook assembly 34 is gradually moved upwardly and outwardly from position A to position B, position B corresponding to the intermediate position of the top section as noted above, with the hook assembly 34 being gradually shifted outwardly and away from the body of the vessel 10 and being lowered somewhat to position C which is the final position occupied by hook assembly 34, at which point the body section 18 of vessel 10 has been rotated sufficiently as to position the top section 20 on the charging side 26 of the operating platform. The above operation is, of course, accomplished in as smooth a fashion as possible thereby to avoid damage to the equipment having regard to the extremely heavy weights involved.

After the vessel top section 20 has been positioned on the operating platform, the hinge 36 is dissassembled by removing hinge pin 42, following which the top section 20 may be removed from the operating platform and taken to a repair site for relining etc., as required.

The technique for installing the repaired or a replacement vessel top section 20 is essentially the reverse of the procedure described above. Firstly, the top section 20 is located on the charging side 26 of the operating platform such that the hinge elements 38 and 40 are in proper juxtaposition with one another following which the hinge pin 42 is inserted. Following this, the body section 18 of the vessel is very slowly rotated from its inclined position towards the upright position while simultaneously applying lifting forces to the top section 20 via the previously described bracket means 44, cables 46 and charging crane lift hook assembly 34. This action is again accomplished as smoothly and as carefully as possible thereby to control the orientation of the top section and such that the top section is lifted upwardly and carried away from the charging side 26 of the operating platform. Thus, the top section 20 gradually pivots relative to the body section 18 about the axis defined by hinge assembly 36 until the top section 20 is gradually brought back into close juxtaposition with the body section 18. Following this, the required bolts are inserted thereby to securely connect flanges 22 and 24 together. The hinge assembly 36 may be allowed to remain on the vessel 10 as a permanent fixture or, alternatively, it may be removed following completion of the installation procedure.

In addition to the savings in time and cost as noted above, this novel method positions the top section 20 of the vessel onto the lower or body section 18 with great accuracy thus minimizing the problems previously involved in centering one section properly relative to the other. Thus, the possibility of damage occurring during the replacement operation is reduced as compared with prior art techniques.

It is further contemplated that this removal and replacement technique may lead to a change in the general relining practice normally carried out following 1200 to 1800 heats. Rather than doing the time-consuming repairs on the vessel top on the site, it may be more advantageous to replace the top section completely and to do the repairs "off site" between relines. In this case the replacement top section to be installed is prebricked with the refractory lining prior to installation. This saves masonry time during the rebuilding operation. The additional weight from the brick work should offer no substantial problem during installation and the brick work should not suffer any damage because of the carefully controlled installation technique afforded by the invention. In addition, the ease with which the vessel flange joints 22 and 24 can be opened and closed by the method of the invention makes it quite simple to install any shims required in the flange joint. Due to distortion from heat and loading, such shimming is frequently required.

It will be apparent to those skilled in the art that various modifications, changes, and additions may be employed in carrying out the method described and illustrated herein, without departing from the spirit and scope of the invention as indicated by the appended claims.

I claim:

1. A method of removing and installing a top section of a steelmaking vessel, the vessel including a lower body section with said top section being detachably secured thereto, there being an operating platform including a vessel charging side alongside of said vessel, said vessel top section further being provided with lift bracket means on that side of the vessel nearest the charging side of the operating platform in the upright position of the vessel, and said body section being mounted for rotation about a horizontal axis, the method including (a) providing a hinge connection between the top section and the body section of the vessel such that the hinge axis thus defined is parallel to the rotation axis of the vessel, said hinge being located to that side of the vessel which is remote from the charging side of the operating platform in the upright position of the vessel;

removing the vessel top section by:

(b) rotating the body section about the rotation axis from an upright position toward the charging side of the operating platform while simultaneously applying lifting forces to said vessel top section via the lift bracket means to support the same whereby the top section pivots relative to said body section about the hinge axis, and continuing the rotation of the body section while supporting the top section and controlling the orientation thereof so that the top section is carried out over the operating platform and progressively lowered onto same;

(c) separating the top section from the body section at the hinge connection and subsequently effecting repair or replacement of the top section;

and subsequently installing the repaired or a replacement vessel top section by:

(d) locating the top section on the operating platform;

(e) connecting the top section to the body section via the hinge connection, and (f) rotating the body section from an inclined position toward an upright position while simultaneously applying lifting forces to the top section via the bracket means to support the top section and to control the orientation thereof such that the top section is carried away from the operating platform and gradually is pivoted relative to the body section about the hinge axis back into close juxtaposition with the body section.

2. A method of removing a top section of a steelmaking vessel, the vessel including a lower body section with said top section being detachably secured thereto, there being an operating platform including a vessel charging side alongside of said vessel, said vessel top section further being provided with lift bracket means on that side of the vessel nearest the charging side of the operating platform in the upright position of the vessel, and said body section being mounted for rotation about a horizontal axis, the method including (a) providing a hinge connection between the top section and the body section of the vessel such that the hinge axis thus defined is parallel to the rotation axis of the vessel, said hinge being located to that side of the vessel which is remote from the charging side of the operating platform in the upright position of the vessel;

(b) rotating the body section about the rotation axis from an upright position toward the charging side of the operating platform while simultaneously applying lifting forces to said vessel top section via the lift bracket means to support the same whereby the top section pivots relative to said body section about the hinge axis, and continuing the rotation of the body section while supporting the top section and controlling the orientation thereof so that the top section is carried out over the operating platform and progressively lowered onto same, and (c) separating the top section from the body section at the hinge connection.

3. A method of installing a top section of a steelmaking vessel, the vessel including a lower body section with said top section being detachably secured thereto, there being an operating platform including a vessel charging side alongside of said vessel, said vessel top section further being provided with lift bracket means on that side of the vessel nearest the charging side of the operating platform in the upright position of the vessel, and said body section being mounted for rotation about a horizontal axis, the method including (a) providing interconnectable hinge portions on both the top section and the body section of the vessel such that the hinge axis defined by the hinge portions when connected together is parallel to the rotation axis of the vessel, said hinge, in the installed condition of the top section, being located to that side of the vessel which is remote from the charging side of the operating platform when the vessel is upright;

(b) locating the top section on the operating platform, the body section being in an inclined position with the hinge portion thereon adjacent the hinge portion on the top section;

(c) connecting the top section to the body section via the hinge portions;

(e) rotating the body section from the inclined position toward an upright position while simultaneously applying lifting forces to the top section via the bracket means to support the top section and to control the orientation thereof such that the top section is carried away from the operating platform and gradually is pivoted relative to the body section about the hinge axis into close juxtaposition therewith;

(f) and securely fastening said top section to the body section of the vessel.

* * * * *